United States Patent [19]

Frank et al.

[11] 4,103,633

[45] Aug. 1, 1978

[54] SEWING MACHINE TRACK STORAGE SYSTEM

[75] Inventors: Carl S. Frank, Clark; John J. Grzybowski, Rahway; Robert S. Peets, Watchung, all of N.J.

[73] Assignee: The Singer Company, New York, N.Y.

[21] Appl. No.: 853,688

[22] Filed: Nov. 21, 1977

[51] Int. Cl.[2] ..... A47B 29/00

[52] U.S. Cl. ..... 112/217.1; 312/29

[58] Field of Search ..... 112/217.1, 258, 260; 312/20, 21, 22, 23, 24, 25, 26, 27, 28, 29, 30

[56] References Cited

U.S. PATENT DOCUMENTS

| | | | |
|---|---|---|---|
| 827,412 | 7/1906 | Bostelman | 312/29 |
| 833,927 | 10/1906 | Hendricks | 312/29 |
| 1,258,520 | 3/1918 | Backermann | 312/29 |
| 1,731,096 | 10/1929 | Erskine | 312/29 |
| 1,778,877 | 10/1930 | Williams | 312/29 |

FOREIGN PATENT DOCUMENTS

| | | | |
|---|---|---|---|
| 1,686,670 | 8/1954 | Fed. Rep. of Germany | 112/217.1 |
| 52-6257 | 1/1977 | Japan | 112/217.1 |

*Primary Examiner*—Henry S. Jaudon

*Attorney, Agent, or Firm*—Michael H. Wallach; Edward L. Bell; Robert E. Smith

[57] ABSTRACT

An improved track storage system for sewing machines having means for permitting the rotation of a sewing machine 90 degrees about its vertical axis. The improved track storage system allows a sewing machine to be stored in a cabinet or enclosure whose depth is sufficient to accommodate the depth of a machine and moved onto the horizontally opened work surface leaf of such an enclosure in a position displaced 90° to its stored position. The improvement is effectuated by an arrangement of tracks which are used to guide and position a plurality of guide studs fixedly attached to and depending from the bottom of the sewing machine base. Two parallel tracks are set into the inside leaf of an enclosure containing a sewing machine so as to form a guideway for moving the machine from its stored position within the enclosure to its operating position on the horizontally opened leaf of the enclosure. The tracks form an extension of a pair of tracks which are attached to the inside base of the sewing machine enclosure. An arc of track is formed at the storage enclosure end of the work leaf. The arc of track cooperates with the guide studs to permit the sewing machine to be rotated 90 degrees about its vertical axis.

4 Claims, 8 Drawing Figures

Fig. 7
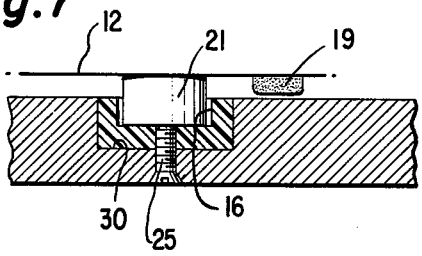
Fig. 1
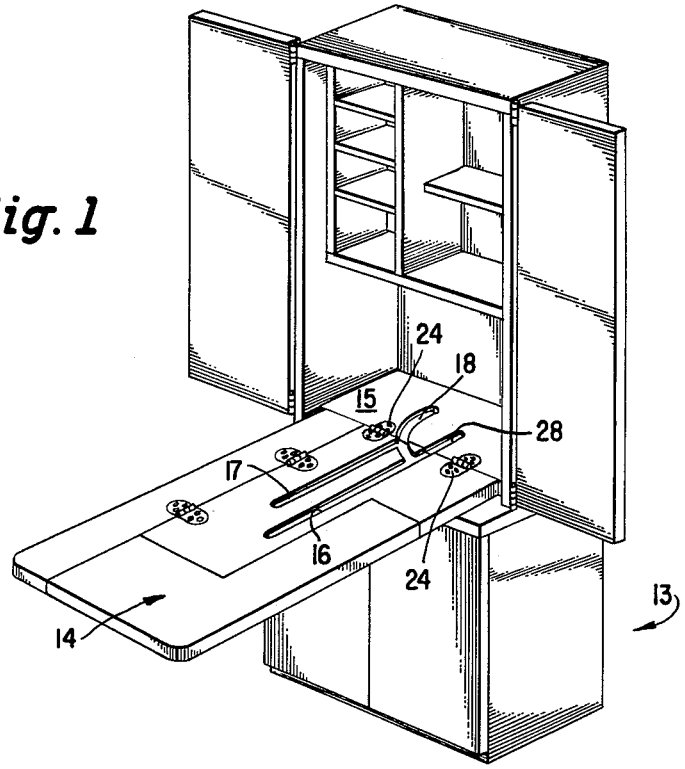
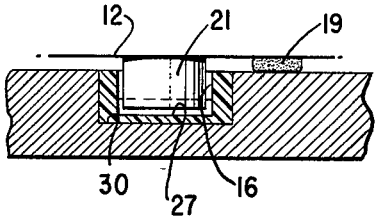
Fig. 8
Fig. 3
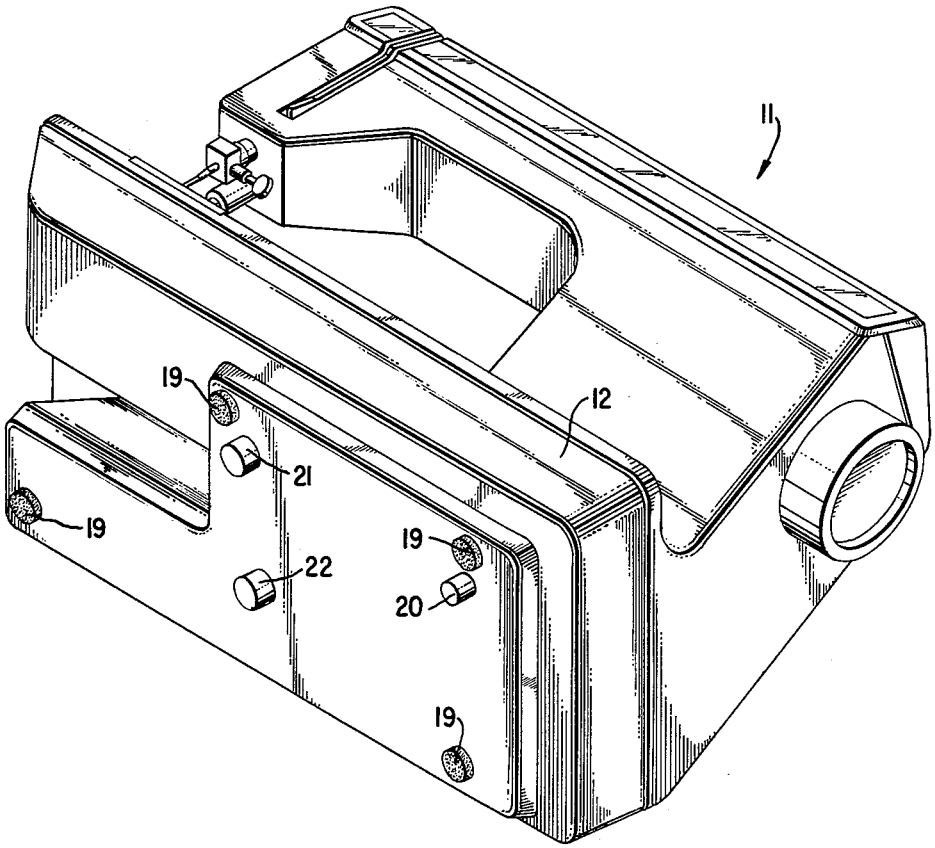

SEWING MACHINE TRACK STORAGE SYSTEM

BACKGROUND OF THE INVENTION

1. Field of the Invention

This invention relates to the field of sewing machines and more specifically to a track storage system for guiding a sewing machine from its stored position in a cabinet or enclosure into an operating position on an adjoining work leaf.

2. Description of the Prior Art

Devices for moving a sewing machine from a stored position to an operating position on a work leaf are well known in the prior art. However, prior art disclosures have shown the use of systems of rollers, tracks, guides, or the like which permit a sewing machine to be slidably moved in a straight line from a storage position to an exposed work leaf. Such systems have the inherent disadvantage of requiring the operator to face the storage cabinet while operating the machine. See for example U.S. Pat. No. 827,412 of July 31, 1906 to Bostelman; German Gebrauchsmuster No. 1,686,670 of Aug. 26, 1954 to Haid and Neu; German Gebrauchsmuster No. 7,021,795 of June 11, 1970 to Goth; and Japanese Lay Open No. 52–6257 of Jan. 18, 1977 to Hanyu et al. Each of the above cited references disclose storage systems for sewing machines or the like in which the machine slides from its storage position into its operating position in a straight line while being guided by tracks, rails, or the like. However, in none of the above cited disclosures is there an arrangement shown by which the machine may be turned through a horizontal arc of 90° to permit an operator to face the machine in its operating position without also facing the storage cabinet.

It is therefore an object of this invention to provide a device for transferring a sewing machine or the like from a stored position in a storage cabinet to an operating position while also permitting it to be rotated through a horizontal angle of 90° so that its operating position will be normal to its stored position. The system will have the additional advantage of allowing the machine to be stored in a cabinet or enclosure whose depth need only be large enough to accommodate the depth dimension of the sewing machine.

SUMMARY OF THE INVENTION

The object of this invention is satisfied by an arrangement of guide tracks for receiving and guiding a plurality of guide studs depending from the base of a sewing machine. One segment of track consists of two parallel tracks set into the inside face of a sewing machine enclosure work leaf. The tracks run perpendicular to the line formed by the intersection of the work leaf and the machine enclosure. The work leaf is so attached to the enclosure that when opened, its inside surface forms a continuation of the plane of the inside base of the enclosure. A second segment of track is contained on the inside base of the enclosure and is so placed that the tracks align with the first set of tracks on the work leaf and form an extension of the first set of tracks when the work leaf is moved into an open position. One track extends from the work leaf into the inside base of the enclosure. The second track consists of an arc of track. The arc of track is so shaped that it cooperates with guide studs located on the base of the sewing machine to permit the machine to be rotated through an arc of 90° about its vertical axis from its stored position, and then slid out into an operating position on the work surface formed by the opened work leaf.

The addition of the circular track segment satisfies the object of the invention by permitting the sewing machine to be rotated about its vertical axis through an arc of 90° so that its operating position will be normal to its storage position. The change in position may be effectuated with a minimum of effort by the operator of the machine.

DESCRIPTION OF THE DRAWINGS

In the accompanying drawings of a preferred embodiment of this invention:

FIG. 1 is a perspective view of a storage cabinet showing the work leaf in an open position and the track storage system attached thereto;

FIG. 3 is an underside perspective view of a sewing machine showing guide studs and support feet depending from the base;

FIG. 7 is a cross section view of a portion of the work leaf of a track storage system taken substantially along line 7—7 of FIG. 5 showing a track recessed into the work leaf and the base of a sewing machine with a guide stud and a support foot;

FIG. 8 is a cross section view of a portion of the work leaf of a track storage system taken substantially along line 8—8 of FIG. 4 showing a track detent for receiving a guide stud to permit the base of the sewing machine to rest upon its support feet.

DETAILED DESCRIPTION OF THE INVENTION

Figure 2:
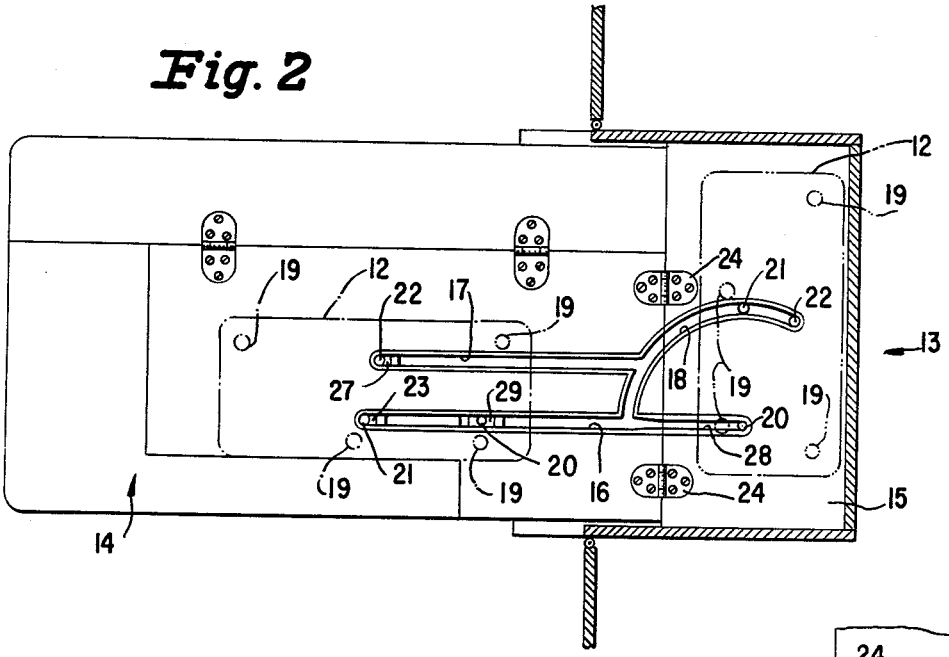
FIG. 2 is a top plan view partially in section of a storage cabinet with the work leaf in an open position and a sewing machine shown in dot and dashed lines in both the operating position and the stored position.

Referring to FIG. 3 of the drawings, 12 indicates the base of a conventional sewing machine 11 which may be used in cooperation with the object of this invention. Indicated in FIG. 1 at 13 is an enclosure of the type adapted to house a sewing machine. A work leaf 14 is hingedly attached to an inside base 15 of enclosure 13 by hinges shown at 24 so that the work leaf can be stored within the enclosure when rotated into an upwardly position. The work leaf and the inside base form a continuous horizontal plane when the work leaf is turned frontwardly open for use.

As illustrated in FIG. 3, the base 12 of the sewing machine 11 has a plurality of support feet 19 depending therefrom. The feet are formed from a material with a high coefficient of friction, as for example, rubber, so that the sewing machine will resist horizontal motion when supported on the feet. Guide studs 20, 21 and 22 are disposed about the base 12 and depend therefrom. The guide studs are cylindrical in shape, with guide stud 20 being smaller in diameter than guide studs 21 and 22, which are of equal diameter. The three guide studs are equal in height to each other and are greater in height than the support feet. Guide stud 20 is disposed beneath the right front corner of the base; guide stud 21 is disposed beneath the left front corner; and guide stud 22 is disposed at the rear of the base. Guide studs 21 and 22 are located on an arc each equidistant from the smaller diameter guide stud 20.

FIG. 1 best illustrates the arrangement of the guide stud accommodating tracks in the work leaf and inside base of the enclosure. The tracks are preferrably formed of molded synthetic plastic material and are arranged in recesses 30 cut into the work leaf and inside base of the enclosure. The tracks include four segments: A first straight segment 16 which extends from the free end of the work leaf toward the inside base 15 of the enclosure; a second straight segment 28 which forms an extension of the first segment and extends into the inside base 15 of the enclosure; a third straight segment 17 which is parallel to the first segment and accommodated in the work leaf 14 of the enclosure; and a circular arcuate segment 18 which traverses the two parallel straight track segments 16 and 17 on the work leaf 14 and continues into the inside base 15 of the enclosure. The tracks are fastened to the work surface 14 by fastener means 25.

Track segment 16 has a width which is greater than the diameter of guide stud 21, whereby the guide stud is permitted to slidably engage the track. Track segment 16 has a depth which is less than the height of guide studs 20, 21 and 22, such that the difference between the height of the guide studs and the depth of the tracks is greater than the height of the support feet, whereby the guide studs support the sewing machine above the work surface 14.

FIG. 2 shows the track segment 16 containing detents 23 and 29. The detents have a depth which is greater than the difference between the height of the guide studs and the depth of the track.

Track extension 28 is so disposed to form an extension of track 16. The track extension 28 extends into inside base 15 of enclosure 13 and has a depth which is equal to the depth of track 16. The track extension 28 has a width which is less than the width of track 16, such that the width of the track extension is greater than the diameter of guide stud 20, whereby guide stud 20 will slidably engage track extension 28. Track extension 28 is equal in length to the distance between guide studs 20 and 21 and is broken at the intersection of work surface 14 and inside base 15 whereby the work leaf can be hingedly closed.

Track 17 is parallel to track 16 and at a distance from track 16 equal to the distance between guide studs 21 and 22. The track is of the same depth and width as track 16.

Figure 4:
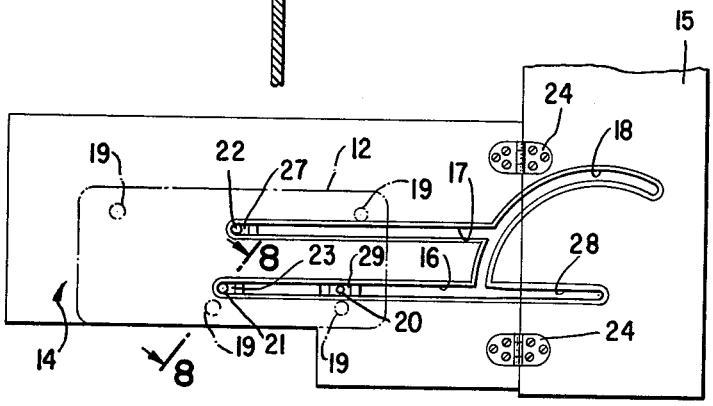
FIG. 4 is a top plan view of fragments of the work leaf and inside base of the cabinet indicating in dot and dashed lines a sewing machine in the sewing position.

Detent 23 on track 16 is so disposed at the frontward end of track 16 to receive guide stud 21 when the sewing machine is moved to the operating position as shown in FIG. 4. Detent 29 is so disposed in track 16 to receive guide stud 20 when the sewing machine is in its operating position. Track 17 contains a detent at the frontward end of the track. The detent is so disposed to receive guide stud 22 when the sewing machine is is the sewing position.

A circular arc of track 18, having a depth and width equal to the depth and width dimensions of track 16, and contained in a recess in the work leaf 14 and inside base 15 and having a radius equal to the distance between guide studs 20 and 21, is so disposed to begin at the intersection of track 16 and track extension 28 on work leaf 14 and to intercept the rearward end of track 17. The center of curvature of track 18 is located at the rear extremity of track segment 28. The circular segment of track 18 embraces guide studs 21 and 22 to guide the guide studs when guide stud 20 is disposed at the rearward end of track extension 28. The arc of the circular segment of track is of such length as to contain guide studs 21 and 22 when the sewing machine is rotated 90° about a vertical axis passing through guide stud 20, to the position shown in FIG. 6. The circular arc of track is broken at the intersection of work leaf 14 and inside base 15 whereby the work leaf can be hingedly closed.

Figure 5:
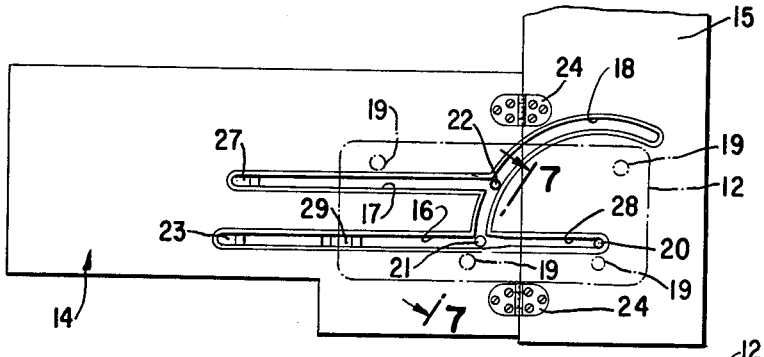
FIG. 5 is a view similar to that of FIG. 4 but indicating in dot and dashed lines the sewing machine at the storage end of the track prior to rotation into the stored position.
Figure 6:
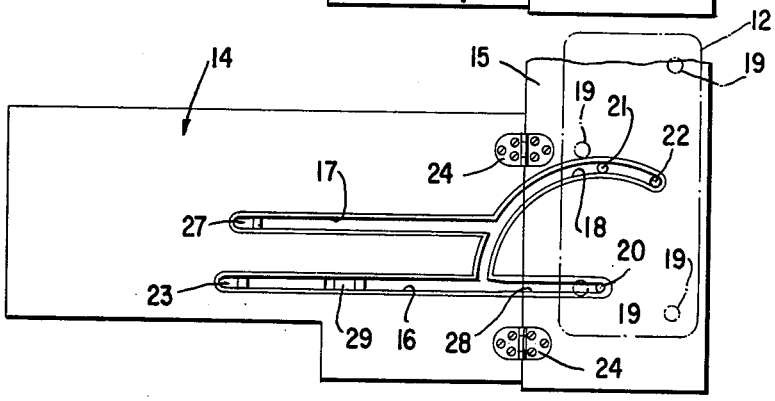
FIG. 6 is a view similar to that of FIG. 4 but indicating in dot and dashed lines the sewing machine in its stored position within the enclosure.

Manipulation of a sewing machine contained in an enclosure having a track storage system in accordance with this invention from its stored to an operative position proceeds in the following manner. Reference is made to FIG. 6 showing a sewing machine in the stored position. Prior to manipulation of the sewing machine, the work leaf 14 is frontwardly opened, thereby forming a flush extension with the inside base 15 of the enclosure. The sewing machine is rotated 90° about a vertical axis passing through guide stud 20 to cause guide studs 21 and 22 to swing along circular track segment 18, while pivoting on guide stud 20. The turning movement ceases when guide stud 21 aligns with track 16 and guide stud 22 aligns with track 17 as shown in FIG. 5. Since the height of guide studs 20, 21 and 22 are greater than the sum of the depth of track 16 or 17 and the height of the support feet, the support feet depending from the base of the sewing machine are held above the surface of the work leaf. After the turning movement has been completed the sewing machine can thereafter translate along tracks 16 and 17 to the frontward end of the work leaf. Upon reaching the work position on the work leaf 14, guide stud 21 engages track detent 23; guide stud 20 engages track detent 29; and guide stud 22 engages detent 27. Since the depth of detents 23, 27 and 29 below the work leaf 14 are greater than the height of guide studs 20, 21 and 22, the sewing machine is caused to fixedly rest upon the plurality of support feet 19 depending from base 12, thereby tending to prevent the movement of the sewing machine about the work leaf 14. The sewing machine is thereby made available for operation in the sewing position as shown in FIG. 4.

To return the sewing machine to its stored position as shown in FIG. 6, the sewing machine is pulled back from its sewing position with a slightly increased force to cause the guide studs to disengage from the track detents. The sewing machine is moved along the track until guide stud 20 contacts the rearward end of track extension 28 as shown in FIG. 5. The sewing machine is placed in the stored position by rotating the sewing machine 90° about a vertical axis passing through guide stud 20 until guide stud 22 reaches the rearward end of circular track segment 18. Work leaf 14 can thereafter be rotated upwardly to enclose the work leaf in enclosure 13.

Having thus set forth the nature of the invention, what is claimed herein is:

1. A track storage system for a sewing machine comprising an enclosure having an inside base; a work leaf attached to said enclosure and rotatable to form a horizontal extension of said inside base; guide means disposed on said work leaf and said inside base, said guide means on said inside base and on said work leaf providing an uninterrupted guide track system when said work leaf is rotated to form a horizontal extension of said inside base; means on said sewing machine for operatively engaging said guide means; said guide means including first portions disposed at the inside surface extremity thereof whereby a sewing machine can be horizontally turned to a position normal to its stored position within said enclosure, and said guide means including second portions disposed at the work leaf extremity thereof, accommodating translational movement of said sewing machine along said guide means to a work position on said work leaf.

2. A track storage system for a sewing machine as set forth in claim 1 wherein said guide means include a plurality of guide tracks having recesses and a plurality of guide studs disposed about and depending from a base of a sewing machine, whereby said guide tracks cooperatively engage and guide said guide studs.

3. A track storage system for a sewing machine as set forth in claim 1 wherein said first portions of said guide means include a curved segment of guide track joining said work leaf and said inside surface.

4. A track storage system for a sewing machine comprising a plurality of guide studs depending from a base of a sewing machine; a first portion of guide track having two parallel segments containing recesses for operatively engaging and guiding said guide studs and accommodating translational motion along said guide track; a second portion of guide track consisting of a straight track forming an extension of one of said first portions of parallel track and a circular arcuate portion of track with a radius equal to the length of said straight track and traversing said first portion of guide track and continuing in the direction of the end of said straight track, said second portion of guide track having recesses for operatively engaging and guiding said guide studs and accommodating rotational motion about a vertical axis of said sewing machine; whereby said sewing machine may be turned from a stored position on said second portion of guide track and moved along said first portion of guide track to a working position normal to said stored position.

* * * * *